US006640392B2

(12) United States Patent
Cherif et al.

(10) Patent No.: US 6,640,392 B2
(45) Date of Patent: Nov. 4, 2003

(54) METHOD AND APPARATUS FOR DETERMINING THE POINT OF REGULATION FOR A DRAFTING UNIT IN A FIBER PROCESSING MACHINE

(75) Inventors: Chokri Cherif, Ingolstadt (DE); Burkhard Wulfhorst, Stolberg (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 10/131,596

(22) Filed: Apr. 25, 2002

(65) Prior Publication Data

US 2002/0133913 A1 Sep. 26, 2002

Related U.S. Application Data

(63) Continuation of application No. 09/995,809, filed on Nov. 29, 2001, now abandoned.

(30) Foreign Application Priority Data

Nov. 29, 2000 (DE) ..... 100 59 262

(51) Int. Cl.[7] ..... D01H 5/00

(52) U.S. Cl. ..... 19/236; 19/239; 19/240

(58) Field of Search ..... 19/236, 238, 239, 19/240, 258, 98, 105, 300; 57/412; 700/130, 142; 702/170

(56) References Cited

U.S. PATENT DOCUMENTS

| | | | | | |
|---|---|---|---|---|---|
| 4,163,927 | A | * | 8/1979 | Grice, Jr. | 318/68 |
| 4,199,844 | A | * | 4/1980 | Goetzinger | 19/240 |
| 4,267,620 | A | * | 5/1981 | Allen, Jr. | 19/239 |
| 4,271,565 | A | * | 6/1981 | Grunder | 19/240 |
| 4,742,675 | A | * | 5/1988 | Leifeld | 57/412 |
| 4,812,993 | A | * | 3/1989 | Konig et al. | 700/142 |
| 4,819,301 | A | * | 4/1989 | Konig et al. | 19/240 |
| 5,161,284 | A | * | 11/1992 | Leifeld | 19/260 |
| 5,274,883 | A | * | 1/1994 | Eke | 19/106 R |
| 5,388,310 | A | * | 2/1995 | Haworth | 19/65 A |
| 5,398,380 | A | * | 3/1995 | Leifeld | 19/98 |
| 5,544,390 | A | * | 8/1996 | Hartung et al. | 19/240 |
| 5,583,781 | A | * | 12/1996 | Denz et al. | 700/130 |
| 5,771,542 | A | | 6/1998 | Dämmig | |
| 5,796,220 | A | * | 8/1998 | Clapp et al. | 318/51 |
| 5,796,635 | A | * | 8/1998 | Dammig | 702/170 |
| 5,926,919 | A | | 7/1999 | Varga | |

FOREIGN PATENT DOCUMENTS

| | | |
|---|---|---|
| DE | 26 48 715 | 5/1978 |
| DE | 33 46 335 | 7/1985 |
| DE | 34 25 345 A1 | 1/1986 |
| DE | 34 29 024 | 2/1986 |
| DE | 36 29 559 | 3/1988 |
| DE | 42 15 682 | 12/1992 |
| DE | 43 06 343 | 7/1994 |
| DE | 196 51 893 | 6/1998 |
| DE | 198 31 139 | 1/2000 |

OTHER PUBLICATIONS

C. Cherif et al., Melliand Textilberichte (Melliand Textile Bulletins) vol. 79 (1998), pp. 403, 404, 406 and 407.

* cited by examiner

*Primary Examiner*—Gary L. Welch
(74) *Attorney, Agent, or Firm*—Venable, LLP; Robert Kinberg; Stuart I. Smith

(57) ABSTRACT

An apparatus for determining a point of regulation in a drafting unit includes a sensor for generating signals as a function of change in a quality-representing magnitude of the fiber material running through the drafting unit; a control device receiving the signals for varying a draft of the fiber material by the drafting unit; and an arrangement for continuously determining, during operation, optimal points of regulation based on the signals.

17 Claims, 3 Drawing Sheets

METHOD AND APPARATUS FOR DETERMINING THE POINT OF REGULATION FOR A DRAFTING UNIT IN A FIBER PROCESSING MACHINE

CROSS REFERENCE TO RELATED APPLICATION

This application is a continuation of application Ser. No. 09/995,809 filed Nov. 29, 2001, now abandoned.

This application claims the priority of German Application No. 100 59 262.7 filed Nov. 29, 2000, which is incorporated herein by reference.

BACKGROUND OF THE INVENTION

This invention relates to a method and an apparatus for determining a point of regulation for drafting units integrated in a fiber processing machine and is of the type in which the change of a quality-characterizing magnitude of the fiber material (for example, its thickness, mass or the like) is measured. The measurement signals are applied to a control device for varying the draft.

The invention is particularly concerned with an evening of textile slivers in drafting units associated with fiber processing machines. In preparation machines frequently a drafting unit is provided in the feed chutes. Likewise, in carding machines or roller cards regulated drafting units may be disposed in the feed chute or in the inlet zone of the machine. At the input of carding machines or roller card units sensors are provided which detect the thickness of the fiber batt and, as a function of the sensed magnitudes, control the rpm of the feed rolls for evening the fiber batt. At the outlet of the carding machines or roller card units sensors are provided for monitoring the sliver mass. The signals corresponding to the sliver mass fluctuation may be used to regulate the feed roll at the input of the machine or to control a drafting unit at the outlet of the machine.

In the regulated draw frames of spinning systems such as cotton spinning, yarn spinning, half yarn spinning, woolen spinning and bast fiber spinning systems, the slivers are caused to converge and are subsequently drafted. During the drafting in the drafting unit, sliver mass fluctuations are compensated for by regulation. In regulated draw frames as well as in carding machines and roller card units, both the control and the regulating principles find application. According to the control principle the sensor for the sliver mass fluctuations is situated upstream of the drafting unit. In the regulating principle, such sensor is positioned downstream of the drafting unit. In either case the signal representing the sliver mass fluctuation is utilized for changing the draft in the principal drafting field.

The detection of mass fluctuations, particularly thickness fluctuations, is effected as a rule with a mechanical scanning system upstream of the input of the draw unit (drafting unit). The measuring signal is stored and after a predetermined delay which corresponds to a certain displacement of the processed material, the regulation is initiated which compensates for the mass fluctuations. Such a point of initiation in time is the point of regulation. The compensation of the mass fluctuations in the principal drafting field is effected by changing the rpm of the regulating motor while at the same time the rpm of the drive motor for the output rolls of the principal drafting field is maintained constant.

Known methods and devices concern the exact preservation of the point of regulation and its correction, while taking into account internal machine effects and/or environmental effects, as disclosed, for example, in German patent documents 42 15 682 and 43 06 343. Further proposals in the prior art concern the effect of the starting and stopping of the regulated draw frames or the inertia behavior of the scanning members and structural groups for driving the rolls of the draw frame. According to European Published Patent Application 803 596, to which corresponds U.S. Pat. No. 5,771,542, setting values for the point of regulation and/or the amplification are determined. In such a system the point of regulation in a test or setting process prior to operation of a draw frame or a carding machine is determined and maintained during operation. The proposals of the prior art are based substantially on maintaining constant the point of regulation during operation. Changes occur only during the preliminary setting steps performed for the machine.

Melliand Textilberichte (Melliand Textile Bulletins), in Volume 79 (1998), pages 403, 404, describe that the behavior of fiber motion in the drafting fields is substantially dependent from the delivery speed. As a rule, at low speeds a uniform fiber motion occurs. At higher speeds, however, a sudden acceleration is experienced in the middle of the drafting field. It has been observed that the speed conditions of the fiber are less constant as viewed along the width of the material and also as a function of time. In addition, in one part of the fibers, accelerations and decelerations alternate in a more pronounced manner, that is, the fiber acceleration is not continuous. These effects may be traced back to an increase of the alternation of sliding/adhering properties and sliver thickness fluctuations. These fluctuations of the fiber motion render the slivers non-uniform.

SUMMARY OF THE INVENTION

It is an object of the invention to provide an improved method and apparatus of the above-outlined type from which the discussed disadvantages are eliminated and which, in particular, provides for a significant improvement in the degree of efficiency of regulation and the uniformity of the drafted sliver and, in particular, the regulating process is additionally optimized.

These objects and others to become apparent as the specification progresses, are accomplished by the invention, according to which, briefly stated, the apparatus for determining a point of regulation in a drafting unit includes a sensor for generating signals as a function of change in a quality-representing magnitude of the fiber material running through the drafting unit; a control device receiving the signals for varying a draft of the fiber material by the drafting unit; and an arrangement for continuously determining, during operation, optimal points of regulation based on the signals.

Thus, according to the invention, the point of regulation is varied during the production process as a function of mass fluctuations to thus significantly improve the efficiency of regulation. According to the invention, first data concerning the mass fluctuation are stored and subsequently, based on the stored values, the optimal points of regulation are determined with the aid of a computing algorithm or by a transfer function. Dependent on the results, to each sliver thickness a point of regulation is assigned. In this manner the point of regulation is variable during operation of the sliver drawing unit.

A microprocessor is expediently used for computing the optimal point of regulation. The detected mass fluctuations which are essential for changing the rpm of the regulating motor and the computed points of regulation associated therewith are stored and are accessed upon reaching the respective point of reaction. The nominal rpm is applied to the regulating motor preferably via a frequency converter. The position of the regulation and thus the extent of displacement from the measuring location associated therewith up to the point of reaction is variable independently from the fiber material.

The particular properties of the fiber materials, for example, the static and dynamic friction behavior as well as type of material may be added into the computing algorithm or the transfer function.

It may be advantageous from the point of view of drafting theory to perform the sliver mass regulation as late as possible in the spinning process. Thus, German patent document 34 25 345 proposes to provide a regulating device in the opening units of open-end spinning machines. Such a solution, however, has not yet been used in the mass producing practice because of cost considerations. The invention may be advantageously utilized in opening units of open-end spinning machines. Here too, first the data on sliver mass fluctuations are stored and subsequently, based on the stored values, the optimal points of regulation are determined with the aid of a computing algorithm or a transfer function so that, according to the results thereof, to each measurement of sliver a point of regulation is assigned. In this manner, the point of regulation is variable during the operation of the regulated draw unit.

The invention, in addition to drafting units of preparation machines, draw frames and open-end spinning machines, may be utilized in draw units of other types of spinning machines, such as flyers, ring spinning or air spinning machines. Such draw units have been heretofore not equipped with regulating devices on a basis of mass manufacture because of cost considerations. From the point of view of drafting technology, the use of a regulating device according to the invention with continuous computation of the point of regulation is a sensible solution.

DESCRIPTION OF THE PREFERRED EMBODIMENTS

Figure 1:
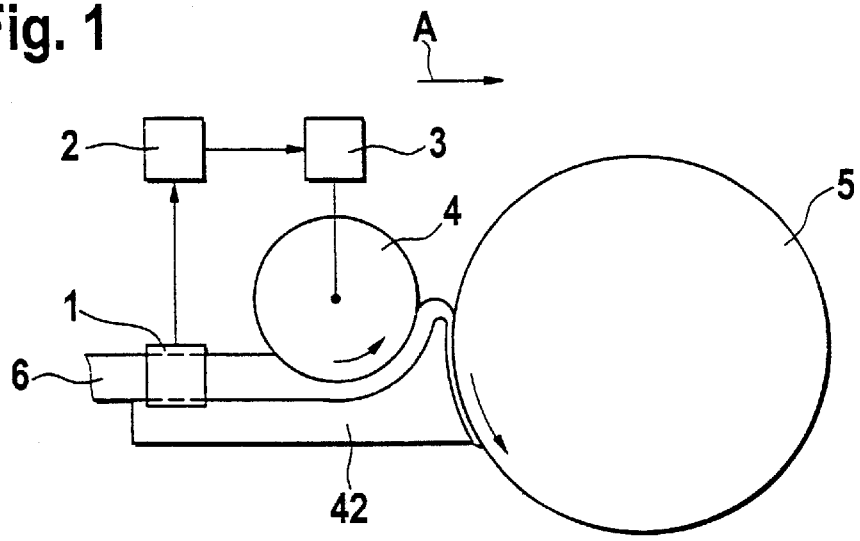
FIG. 1 is a schematic side elevational view of the fiber batt intake device at the inlet of a carding machine or a roller card unit, incorporating the invention for performing a short-term regulation.

FIG. 1 illustrates the feeding device of a roller card unit or a carding machine which may be a high-performance DK 903 model manufactured by Trützschler GmbH & Co. KG, Mönchengladbach, Germany. The fiber batt 6 is advanced to a licker-in 5 by a feed roller 4 in cooperation with a feed table 42. The processing direction is designated with the arrow A. The mass of the sliver 6 entering the nip defined between the feed roller 4 and the feed table 42 is detected by a sensor 1 whose signals are applied to a regulator 2. The latter, in turn, applies its signals to a drive 3 for rotating the feed roller 4. The rpm of the feed roller 4 is varied by the motor 3 as a function of the signals applied thereto by the regulator 2.

Figure 2:
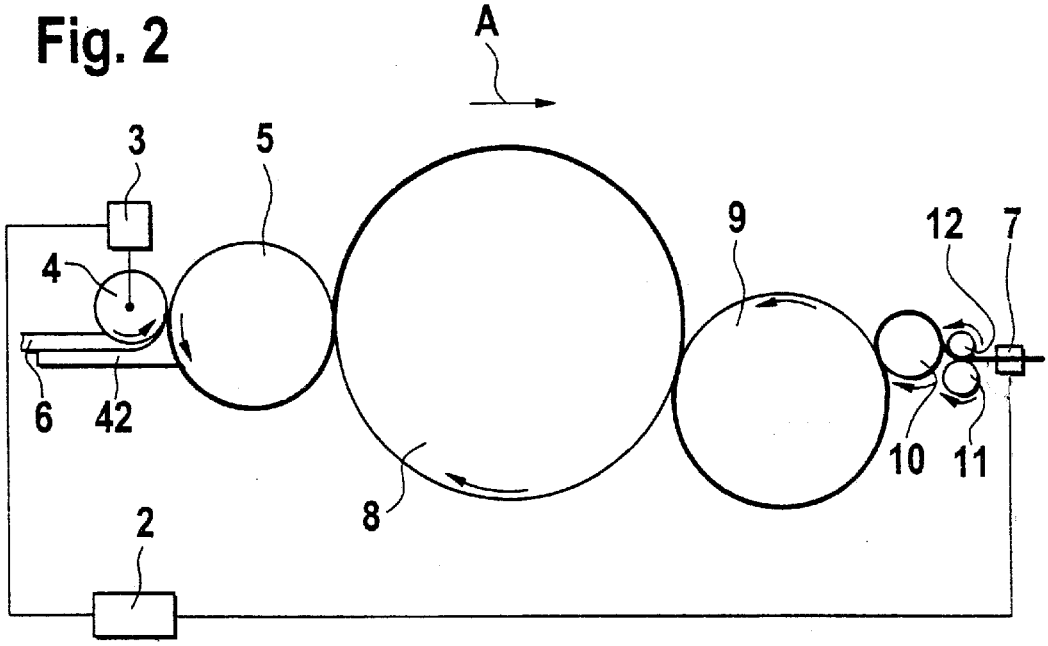
FIG. 2 is a schematic side elevational view of a carding machine incorporating the invention for a long-term regulation.

FIG. 2 shows a carding machine in which the licker-in 5 transfers fiber material to the main carding cylinder 8. Thereafter, the fiber material is taken over by a doffer 9 cooperating with a stripping roll 10. Subsequently, the material passes between crushing rolls 11, 12. A sensor 7 positioned downstream of the crushing rolls 11, 12 monitors the mass of sliver outputted by the carding machine. The sliver, after passing the sensor 7 travels through a non-illustrated drafting unit. The signal from the sensor 7, representing the sliver mass, is utilized for the long-term regulation by virtue of the fact that the signal representing the sliver mass is applied to the feed roll drive motor 3 via the regulator 2. In both regulating devices according to FIGS. 1 and 2 the point of regulation is changed in a continuous manner.

Figure 3:
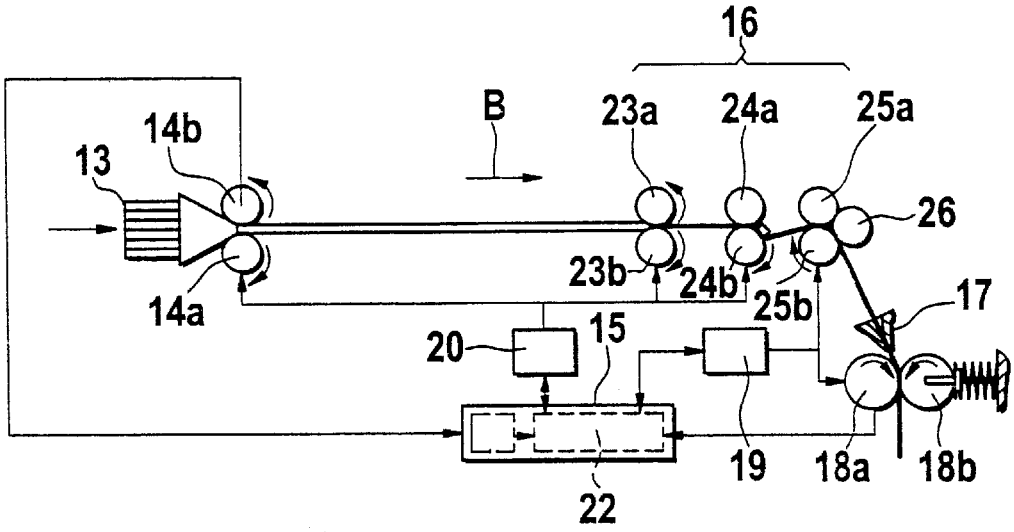
FIG. 3 is a schematic side elevational view of a draw frame incorporating the invention.

FIG. 3 illustrates the drafting unit of a cotton draw frame, such as, for example, a high-performance HS model manufactured by Trützschler GmbH & Co. KG. A plurality of slivers 13 runs side-by-side, in direction B, through a sensing device 14*a*, 14*b* which continuously registers the sliver thickness and applies the signals derived therefrom to a control device 15. Thereafter, the doubled slivers run through a draw unit 16 which, as a rule, is composed of three roll pairs between which the drafting proper takes place. The draw unit is formed of a preliminary drafting zone defined between the roll pairs 23*a*, 23*b* and 24*a*, 24*a* and a principal drafting zone defined between the rolls pairs 24*a*, 24*b* and the roll assembly 25*a*, 25*b*, 26. The drafted sliver is, by means of a sliver trumpet 17, combined into a single drafted sliver and passes through a second sliver sensing organ 18*a*, 18*b* and a sliver guiding unit before being deposited in a coiler can (neither shown). The last (output) rolls 25*a*, 25*b* of the drafting unit 16 are driven at a constant velocity by an electric motor 19. The roll pairs 23*a*, 23*b* as well as 24*a*, 24*b* which are situated upstream of the rolls 25*a*, 25*b* are driven by an rpm-variable motor 20. Based on the different circumferential velocities of the roll pairs, the slivers are drafted, and the extent of draft is a function of the velocity relationships between the roll pairs. The rpm changes of the motor 20 thus result in a change of the extent of draft. Such a change is controlled by the control device 22 with the aid of a setting signal which is correlated with the mass fluctuations of the slivers in the input zone of the draw unit.

Figure 4:
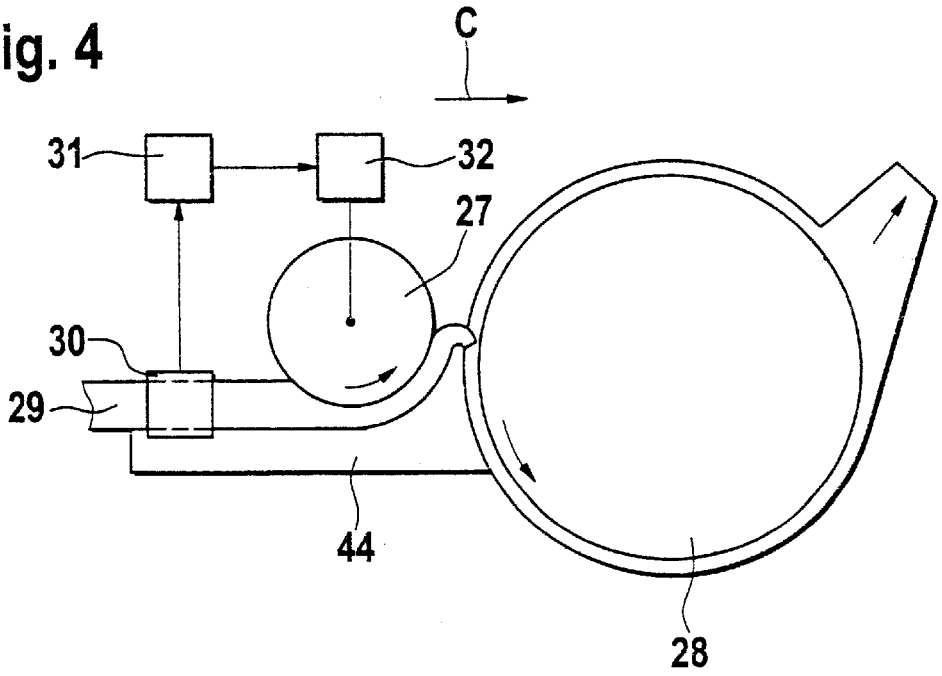
FIG. 4 is a schematic side elevational view of the opening unit of an open-end spinning machine, incorporating the invention.

FIG. 4 shows a regulating device associated with the opening unit of an open-end spinning machine and includes a feed roll 27, a feed table 44 and an opening roll 28. The fiber material entering the device is designated at 29, and moves generally in direction C. As a first step, the sliver mass fluctuations are detected by a measuring member 30. Subsequently, based on the detected values, the optimal points of regulation are determined by a regulator 31 with the aid of a computing algorithm or a transfer function, so that, as a result, with each sliver measurement a point of regulation is associated. The point of regulation is thus variable during operation of the regulated draw unit.

Figure 5:
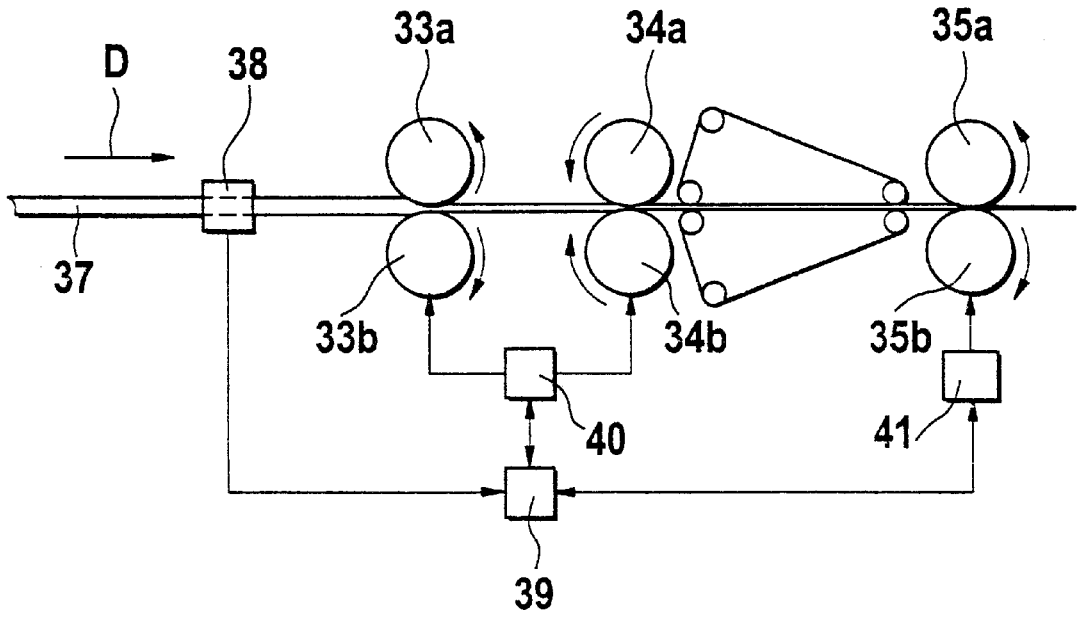
FIG. 5 is a schematic side elevational view of the draw unit of a ring-spinning machine incorporating the invention.

In FIG. 5 the device according to the invention is associated with the draw unit of a ring-spinning machine having a sliver movement direction D. The sensor 38, detecting mass fluctuations of the sliver 37, applies its signals to a regulator 39 which, in turn, controls a motor 40 driving the two roll pairs 33*a*, 33*b* and 34*a*, 34*b*. The motor 41 drives the output roll pair 35*a*, 35*b* with a constant speed. On the basis of the detected values the optimal points of regulation are determined with the aid of a computing algorithm or a transfer function so that as a result, with each measurement of the sliver mass a point of regulation is associated. In this manner, the point of regulation of the draw unit is variable during operation.

It will be understood that the above description of the present invention is susceptible to various modifications, changes and adaptations, and the same are intended to be comprehended within the meaning and range of equivalents of the appended claims.

What is claimed is:

1. A method of determining a point of regulation in a drafting unit, comprising the following steps:

(a) passing fiber material through the drafting unit;

(b) generating signals as a function of change in a quality-representing magnitude of the running fiber material;

(c) applying said signals to a control device for varying a draft of the fiber material by the drafting unit; and (d) continuously determining during operation optimal points of regulation based on said signals.

2. The method as defined in claim 1, further comprising the step of continuously applying said optimal points of regulation to said control device.

3. The method as defined in claim 1, wherein step (d) comprises the step of determining said optimal points of regulation by mathematical algorithms.

4. The method as defined in claim 1, wherein step (d) comprises the step of determining said optimal points of regulation by mathematical algorithms based on thickness fluctuations of the running fiber material.

5. The method as defined in claim 1, wherein step (d) comprises the step of determining said optimal points of regulation by mathematical algorithms presented as transfer functions.

6. The method as defined in claim 1, wherein signals representing said optimal points of regulation are applied to a control device of said drafting unit for changing a position of regulation.

7. The method as defined in claim 1, wherein said drafting unit has a principal drafting field; further wherein step (c) comprises the step of varying the draft in the principal drafting field.

8. An apparatus for determining a point of regulation in a drafting unit, comprising the following steps:

(a) means for passing fiber material through the drafting unit;

(b) a sensor for generating signals as a function of change in a quality-representing magnitude of the running fiber material;

(c) a control device receiving said signals for varying a draft of the fiber material by the drafting unit; and (d) means for continuously determining, during operation, optimal points of regulation based on said signals.

9. The apparatus as defined in claim 8, in combination with the drafting unit and a fiber processing machine; said drafting unit forming part of said fiber processing machine.

10. The apparatus as defined in claim 8, in combination with the drafting unit and a carding machine; said drafting unit forming part of said carding machine.

11. The apparatus as defined in claim 8, in combination with the drafting unit and a roller card unit; said drafting unit forming part of said roller card unit.

12. The apparatus as defined in claim 8, in combination with the drafting unit and a draw frame; said drafting unit forming part of said draw frame.

13. The apparatus as defined in claim 8, in combination with the drafting unit and a spinning machine; said drafting unit forming part of said spinning machine.

14. apparatus as defined in claim 8, in combination with the drafting unit and a ring-spinning machine; said drafting unit forming part of said ringhine.

15. The apparatus as defined in claim 8, in combination with the drafting unit and an open-end spinning machine; said drafting unit forming part of said open-end spinning machine.

16. The apparatus as defined in claim 8, wherein said control device comprises a microcomputer including a microprocessor.

17. The apparatus as defined in claim 16, wherein said microprocessor is embeddedd in said control device for computing the points of regulation.

* * * * *